US006133817A

United States Patent [19]

Hofsäss et al.

[11] Patent Number: 6,133,817

[45] Date of Patent: Oct. 17, 2000

[54] TEMPERATURE-DEPENDENT SWITCH

[75] Inventors: Marcel Hofsäss, Neuenbürg; Michael Becher, Althengstett; Edwin Güttinger, Königsbach, all of Germany

[73] Assignee: Thermik Geratebau GmbH, Pforzheim, Germany

[21] Appl. No.: 09/289,821

[22] Filed: Apr. 12, 1999

[30] Foreign Application Priority Data

Apr. 16, 1998 [DE] Germany ..... 198 16 807

[51] Int. Cl.[7] ..... H01H 37/14; H01H 37/04; H01H 37/52

[52] U.S. Cl. ..... 337/377; 337/380; 337/362; 337/100; 337/102; 337/107; 337/324

[58] Field of Search ..... 337/14, 324, 102, 337/103, 104, 16, 36, 97, 298, 333, 362, 343, 377, 390, 380, 53, 77, 100, 107; 29/622

[56] References Cited

U.S. PATENT DOCUMENTS

| | | | |
|---|---|---|---|
| 2,753,421 | 7/1956 | Mertler | 337/347 |
| 3,265,839 | 8/1966 | Johnson | 337/91 |
| 3,308,255 | 3/1967 | Faggiano | 337/367 |
| 4,399,423 | 8/1983 | Nield | 337/102 |
| 4,528,540 | 7/1985 | Stiekel et al. | 337/102 |
| 4,620,175 | 10/1986 | Karr et al. | 337/343 |
| 4,862,132 | 8/1989 | Hollweck | 337/102 |
| 5,233,325 | 8/1993 | Takeda | 337/107 |
| 5,268,664 | 12/1993 | Givler | 337/380 |
| 5,309,131 | 5/1994 | Hofsass et al. | 337/102 |
| 5,428,336 | 6/1995 | Smith et al. | 337/365 |
| 5,615,072 | 3/1997 | Hofsass et al. | 361/24 |

FOREIGN PATENT DOCUMENTS

| | | | |
|---|---|---|---|
| 2113388 | 10/1971 | Germany . | |
| 3320730 | 7/1984 | Germany . | |
| 4142716 | 6/1993 | Germany . | |
| 4336564 | 5/1994 | Germany . | |
| 411195364A | 7/1999 | Japan | H01H 61/02 |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature-dependent switch 10 has two connection electrodes 12, 13 mounted on an insulating support 11 as well as a switching mechanism 27 that, as a function of its temperature, makes an electrically conductive connection between the two connection electrodes 12, 13. A resistance element 19 is connected to the two connection electrodes 12, 13 electrically parallel to the switching mechanism 27 and sits on the outside of the insulating support 11 and is retained by it.

10 Claims, 2 Drawing Sheets

TEMPERATURE-DEPENDENT SWITCH

BACKGROUND OF THE INVENTION

1. Field of the Invention

The present invention is related to a temperature-dependent switch having two connection electrodes mounted on an insulating support, a switching mechanism that as a function of its temperature makes an electrically conductive connection between the two connection electrodes, and a resistance element that is connected to the two connection electrodes electrically parallel to the switching mechanism.

2. Related Prior Art

A switch of this kind is known from DE 21 13 388 A.

The known switch is a thermostat for protecting an electrical device, which is connected electrically in series with the device to be protected and is in thermal contact with the device.

The two connection electrodes are planar metal parts of which one carries a fixed countercontact and the other a bimetallic element on whose free end sits a movable countercontact coacting with the fixed countercontact. The two metal parts are arranged one above another, and clamp between them a PTC resistor that, with interposition of a spring, is in electrical contact with both connection electrodes.

This configuration made up of insulating support, metal parts with fixed and movable countercontacts, and PTC resistor is slid into a housing, whereupon the housing opening is encapsulated with a sealing compound.

If the temperature of the device being protected exceeds the response value of the bimetallic element, the latter lifts the movable countercontact away from the fixed countercontact, thereby interrupting the supply of current to the device. A small residual current now flows through the PTC resistor arranged parallel to the switching mechanism thus constituted, developing sufficient heat to hold the switching mechanism open; this function is called "self-holding."

A disadvantage with the known switch is that the PTC resistor is mechanically retained only when the switch is completely assembled, making assembly of this switch quite complex. Replacement of the PTC resistor is not possible.

A further self-holding temperature-dependent switch is known from DE 43 36 564 A1. This known switch comprises a bimetallic switching mechanism arranged in an encapsulated housing. The housing is arranged on a support plate on which conductor paths and resistors are provided. A PTC resistor, which is soldered parallel to the switching mechanism with external connectors, is provided outside the housing on the support.

A disadvantage of this switch is that it not only requires a relatively large number of components, but also has large dimensions.

SUMMARY OF THE INVENTION

In view of the above, it is an object of the present invention to improve the temperature-dependent switch mentioned at the outset in such a way that it can be assembled economically and easily; preferably, replacement of the resistance element is to be possible.

According to the present invention, this object is achieved in the case of the switch mentioned an the outset in that the resistance element sits on the outside of the insulating support and is retained by it.

The object underlying the invention is completely achieved in this fashion.

Specifically, the inventors of the present application have recognized that a surprisingly simple switch can be created if the resistance element is not arranged inside the switch or on a separate support next to the switch, but rather is directly retained on the outside, on the insulating support. The switch can then first be completely fabricated before the resistance element is then mounted subsequently from the outside. If the resistance element is dispensed with, the switch does not have the self-hold function, but in many applications this is sufficient.

If, on the other hand, the switch is to be equipped with a self-hold function, all that is necessary is to mount the resistance element from the outside, for example to connect it with the two connection electrodes by soldering. It is now possible, with one and the same basic switch, to selectably insert different resistance elements in order to adapt to different utilization conditions in terms of operating current and response temperature. The result is a great advantage in terms of production, since the switch as such can be prefabricated in large quantities so that later the various resistors merely need to be added. This possibility was also offered by the switch known from DE 43 36 564 A1 cited above, but there the subsequent installation of the resistance element was very complex. In contrast, DE 21 13 388 A, also mentioned above, does not allow this partial production of the switch; the PTC resistor, clamped between the connection electrodes in the interior of the housing, needed to be delivered in the correct configuration during production itself.

Altogether the new switch thus offers the advantage that the basic switch can be prefabricated and then later equipped, to order, with a resistor. Since it is thereby possible to manufacture the basic switch in a single production operation in much greater quantities, specifically because the specialization of the switch is not defined until later, the overall result is also a decrease in production costs, since the lot size for production of the basic switch can be much larger than in the case of the generic switch.

In an improvement, it is preferred if the two connection electrodes comprise planar metal parts which are arranged one beside the other in one plane; and if the resistance element rests on the metal parts.

This feature is also advantageous in terms of assembly engineering, since the electrical connection between the resistance element and the connection electrodes is accomplished via the geometrical arrangement of the resistance element on the connection electrodes, where they are held by the insulation element. Under certain circumstances this may even render the before-mentioned soldering step, or any similar connection step, superfluous.

It is further preferred if the insulating support is equipped with projections which clamp the resistance element between them and press it onto the connection electrodes.

This feature is also advantageous in terms of assembly engineering; the resistance element needs be pressed, so to speak, only from outside between the projections, where it is then simultaneously held by their spring effect and pushed onto the connection electrodes. Later replacement of the resistance element is, however, also possible as a result; this can be advantageous under certain utilization conditions.

In general, it is also preferred if the one connection electrode carries a fixed countercontact and the other a bimetallic element on whose free end sits a movable countercontact coacting with the fixed countercontact.

The advantage with this feature is that a technically very simple switching mechanism is used, in which the operating current flows through the bimetallic element itself so that a further spring part can be dispensed with.

It is further preferred if the resistance element is a PTC block.

The advantage here in terms of assembly engineering is that an easily handled and easily contacted PTC block is used, the outer surfaces of which can be configured in known fashion as terminals.

Further advantages are evident from the description and the appended drawings. It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the drawings and will be explained in more detail in the description below. In the drawings.

DETAILED DESCRIPTION OF A PREFERRED EMBODIMENT

Figure 1:
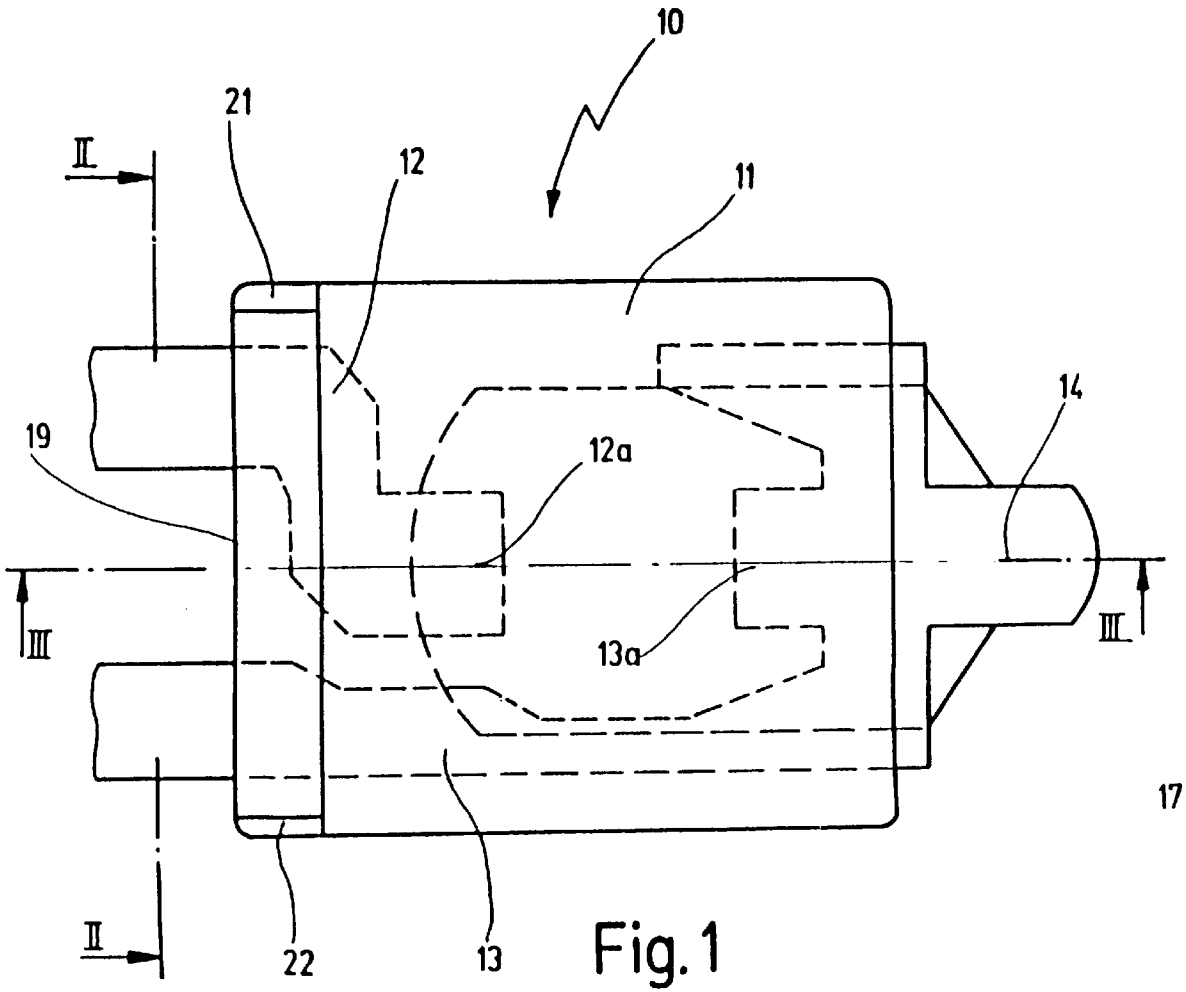
FIG. 1 shows a plan view of a schematically shown temperature-dependent switch, with connection electrodes indicated using dashed lines.

In FIG. 1, 10 designates a temperature-dependent switch which comprises an insulating support 11 on which two connection electrodes 12, 13, shown with dashed lines in FIG. 1, are mounted. Connection electrode 13 is L-shaped and connection electrode 12 is Z-shaped, so that they face toward one another with their contact ends 12*a*, 13*a* in the longitudinal axis of switch 10.

Figure 2:
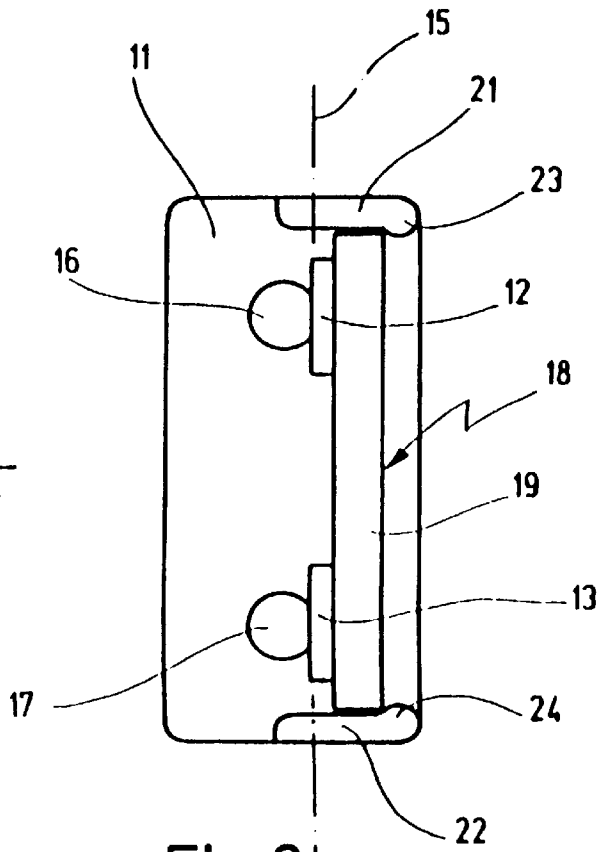
FIG. 2 shows a side view of the switch along line II—II in FIG. 1.

As can be seen best in FIG. 2, the two connection electrodes 12, 13 comprise planar metal parts which are arranged one beside the other in a plane indicated as 15. Soldered to the bottom of the connection electrodes 12, 13 are flexible connecting leads 16, 17 that serve as connection for the switch 10.

Resting on connection electrodes 12, 13 is a resistance element 18 which in the embodiment shown is a PTC block 19.

The insulating support 11 is provided on its sides with resilient projections 21, 22, pointing to the left in FIG. 1, that extend transversely to the plane 15 and beyond the drawing plane of FIG. 2. Projections 21, 22 clamp PTC block 19 between them, and overlap it with respective bulging portions 23, 24, thereby pressing PTC block 19 onto connection electrodes 12, 13. PTC block 19 can be slid, from the left side in FIG. 1, between the connection electrodes 12, 13 and projections 21, 22, so that it comes to sit on the outside of insulating support 11, and is retained by the latter and simultaneously connected electrically parallel between the two connection electrodes 12, 13.

Figure 3:
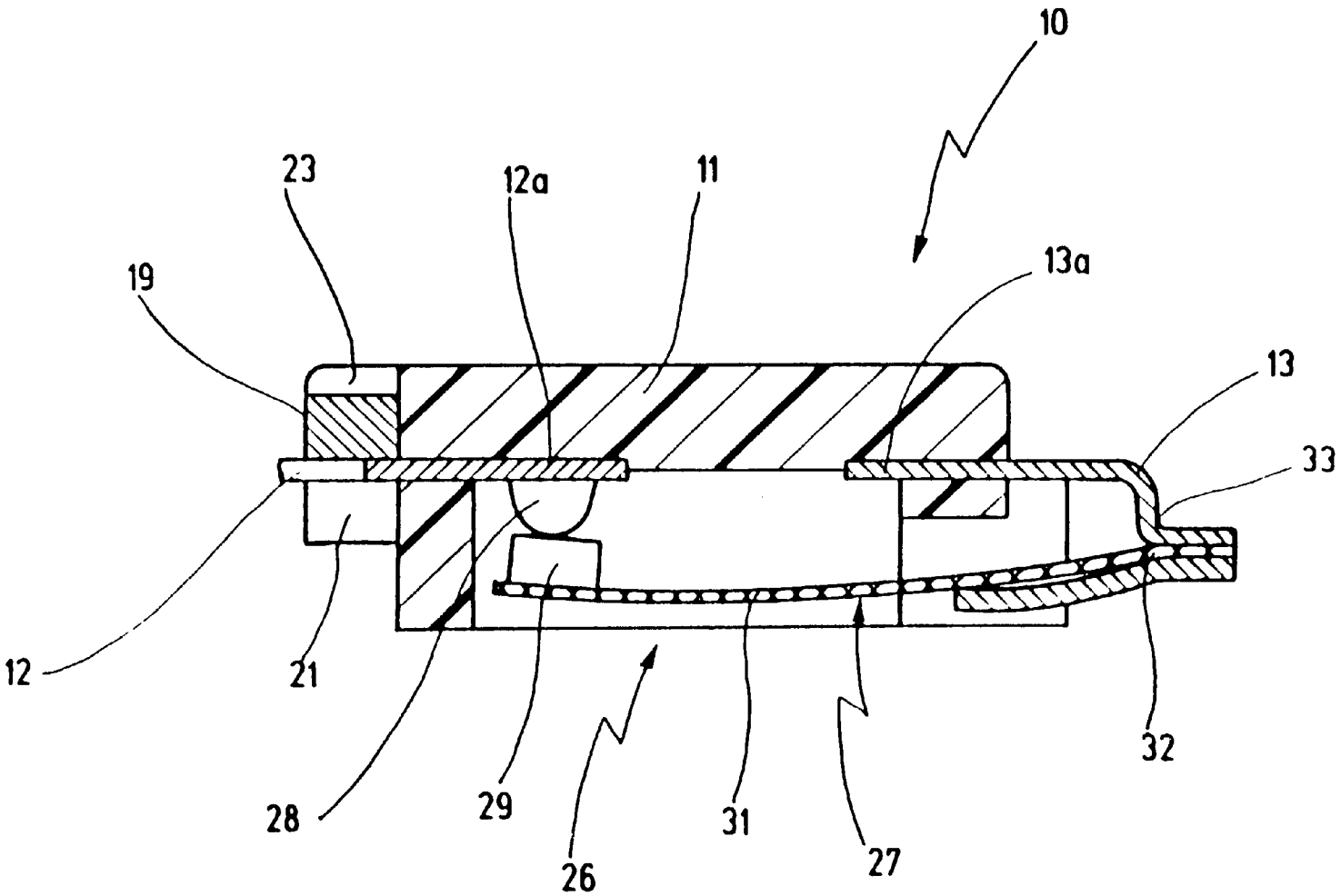
FIG. 3 shows a sectioned representation of the switch along line III—III of FIG. 1.

It is evident from the sectioned representation of FIG. 3 that a cavity 26, in which a temperature-dependent switching mechanism 27 is arranged, is provided in insulating support 11. Into this cavity, contact end 12*a* of the connection electrode 12 projects from the left, and contact end 13*a* of the connection electrode 13 from the right, the two connection electrodes 12, 13 being arranged in one plane also in the area of the cavity 26.

Connection electrode 12 carries at its contact end 12*a* a fixed countercontact 28 which coacts with a movable countercontact 29 that is arranged at a free end of a bimetallic spring 31. At its other end 32, bimetallic spring 31 is joined to a bent part 33 of connection electrode 13.

In the position shown in FIG. 3, bimetallic spring 31 is in its low-temperature position in which it pushes movable countercontact 29 against fixed countercontact 28, thus creating an electrically conductive connection between the two connection electrodes 12, 13. With its connection electrodes 12, 13, switch 10 is connected in series in an electrical circuit with an electrical device to be protected, the operating current of the device being passed through connection electrodes 12, 13 and bimetallic spring 31. If the temperature of switch 10 and thus of bimetallic spring 31 then increases above the switching temperature, bimetallic spring 31 lifts movable countercontact 29 away from fixed countercontact 28, thereby interrupting the circuit so that the protected device is switched off.

A residual current nevertheless continues to flow through PTC block 19, which is arranged electrically parallel to switching mechanism 27. The residual current flowing through PTC block 19 raises the temperature of the connection electrodes 12, 13 so that heat is transmitted, by heat transmission, to the inside of switch 10 whereby the bimetallic spring 31 is kept above its switching temperature so that switch 10 cannot automatically close again. Only after supply of power has been interrupted does PTC block 19 and thus also the rest of switch 10 cool off sufficiently for switching mechanism 27 to be able to close again.

PTC block 19 can be designed differently in terms of its resistance, so that different switching temperatures can be obtained. All that is necessary to achieve this is to slide different PTC blocks 19 between the resilient projections 21, 22 and connection electrodes 12, 13.

Therefore, what we claim, is:

1. A temperature-dependent switch having two connection electrodes mounted on an insulating support, a switching mechanism that as a function of its temperature makes an electrically conductive connection between the two connection electrodes, and a resistance element that is removably connected to the two connection electrodes electrically parallel to the switching mechanism, wherein the resistance element sits on the outside of the insulating support and is resiliently retained by it, such that the resistance element is replaceable.

2. The switch as in claim 1, wherein the two connection electrodes comprise planar metal parts which are arranged one beside the other in one plane, and the resistance element rests on the metal parts.

3. The switch as in claim 1, wherein the insulating support is equipped with projections which clamp the resistance element between them and press it onto the connection electrodes.

4. The switch as in claim 1, wherein the one connection electrode carries a fixed countercontact and the other connection electrode a bimetallic element on whose free end sits a movable countercontact coacting with the fixed countercontact.

5. The switch as in claim 3, wherein the one connection electrode carries a fixed countercontact and the other connection electrode a bimetallic element on whose free end sits a movable countercontact coacting with the fixed countercontact.

6. The switch as in claim 1, wherein the resistance element is a PTC block.

7. The switch as in claim 5, wherein the resistance element is a PTC block.

8. A temperature-dependent switch having two connection electrodes mounted on an insulating support, a switching mechanism that as a function of its temperature makes an electrically conductive connection between the two connection electrodes, and a resistance element that is connected to the two connection electrodes electrically parallel to the switching mechanism, wherein the resistance element sits on the outside of the insulating support and is retained by it, wherein the insulating support is equipped with projections which clamp the resistance element between them and press it onto the connection electrodes.

9. The switch as in claim 8, wherein the two connection electrodes comprise planar metal parts which are arranged one beside the other in one plane, and the resistance element rests on the metal parts.

10. The switch as in claim 8, wherein the one connection electrode carries a fixed countercontact and the other connection electrode a bimetallic element on whose free end sits a movable countercontact coacting with the fixed countercontact.

* * * * *